US009822653B2

(12) United States Patent
Porter et al.

(10) Patent No.: US 9,822,653 B2
(45) Date of Patent: Nov. 21, 2017

(54) COOLING STRUCTURE FOR STATIONARY BLADE

(71) Applicant: General Electric Company

(72) Inventors: Christopher Donald Porter, Greenville, SC (US); Christopher Lee Golden, Greer, SC (US)

(73) Assignee: General Electric Company, Schenectady, NY (US)

( * ) Notice: Subject to any disclaimer, the term of this patent is extended or adjusted under 35 U.S.C. 154(b) by 290 days.

(21) Appl. No.: 14/801,197

(22) Filed: Jul. 16, 2015

(65) Prior Publication Data

US 2017/0016338 A1 Jan. 19, 2017

(51) Int. Cl.

| | |
|---|---|
| ***F01D 9/04*** | (2006.01) |
| ***F01D 5/18*** | (2006.01) |
| ***F01D 25/12*** | (2006.01) |

(52) U.S. Cl.

CPC ..... *F01D 9/041* (2013.01); *F01D 5/187* (2013.01); *F01D 25/12* (2013.01); *F05D 2240/12* (2013.01); *F05D 2240/81* (2013.01); *F05D 2260/2214* (2013.01); *F05D 2260/22141* (2013.01)

(58) Field of Classification Search

CPC . F01D 25/12; F01D 5/187; F01D 9/02; F01D 9/041; F01D 9/065; F01D 9/04; F01D 5/186; F05D 2220/30; F05D 2240/122; F05D 2240/128; F05D 2240/81; F05D 2250/71; F05D 2260/2214

See application file for complete search history.

(56) References Cited

U.S. PATENT DOCUMENTS

| | | | |
|---|---|---|---|
| 3,885,609 | A | 5/1975 | Frei et al. |
| 3,989,412 | A | 11/1976 | Mukherjee |
| 6,761,529 | B2 | 7/2004 | Soechting et al. |
| 7,625,172 | B2 | 12/2009 | Walz et al. |

(Continued)

FOREIGN PATENT DOCUMENTS

| | | |
|---|---|---|
| EP | 2407639 A1 | 1/2012 |
| EP | 2469034 A2 | 6/2012 |
| EP | 2 610 435 A1 | 7/2013 |

OTHER PUBLICATIONS

Combined Search and Examination Report issued in connection with corresponding GB Application No. 1612049.5 dated Dec. 15, 2016.

*Primary Examiner* — Dwayne J White
*Assistant Examiner* — Peter T Hrubiec
(74) *Attorney, Agent, or Firm* — Ernest G. Cusick; Hoffman Warnick LLC

(57) ABSTRACT

Embodiments of the present disclosure provide a cooling structure for a stationary blade. The cooling structure can include: an airfoil having a cooling circuit therein; an endwall coupled to a radial end of the airfoil; a chamber positioned within the endwall for receiving a cooling fluid from the cooling circuit, wherein the cooling fluid absorbs heat from the endwall, and a temperature of the cooling fluid in an upstream region is lower than a temperature of the cooling fluid in a downstream region; a first passage within the endwall fluidly connecting the upstream region of the chamber to a wheel space positioned between the endwall and the turbine wheel; and a second passage within the endwall fluidly connecting the downstream region of the chamber to the wheel space.

20 Claims, 7 Drawing Sheets

(56) References Cited

U.S. PATENT DOCUMENTS

| | | | | |
|---|---|---|---|---|
| 7,785,067 | B2 | 8/2010 | Lee et al. | |
| 8,096,772 | B2 | 1/2012 | Liang | |
| 8,231,329 | B2 | 7/2012 | Benjamin et al. | |
| 8,292,573 | B2 * | 10/2012 | Broomer | F01D 9/041 415/178 |
| 8,356,978 | B2 | 1/2013 | Beattie et al. | |
| 8,439,643 | B2 | 5/2013 | Kuhne et al. | |
| 2002/0150474 | A1 | 10/2002 | Balkcum, III et al. | |
| 2010/0129199 | A1 | 5/2010 | Davis | |
| 2010/0239432 | A1 * | 9/2010 | Liang | F01D 11/001 416/97 R |
| 2011/0058957 | A1 | 3/2011 | Von Arx et al. | |
| 2011/0189000 | A1 | 8/2011 | Vedhagiri et al. | |
| 2013/0004295 | A1 | 1/2013 | Naryzhny et al. | |
| 2013/0028735 | A1 | 1/2013 | Burt et al. | |
| 2013/0171005 | A1 | 7/2013 | Ellis et al. | |
| 2014/0000285 | A1 | 1/2014 | Bergman et al. | |

* cited by examiner

COOLING STRUCTURE FOR STATIONARY BLADE

BACKGROUND OF THE INVENTION

The disclosure relates generally to stationary blades, and more particularly, to a cooling structure for a stationary blade.

Stationary blades are used in turbine applications to direct hot gas flows to moving blades to generate power. In steam and gas turbine applications, the stationary blades are referred to as nozzles, and are mounted to an exterior structure such as a casing and/or an internal seal structure by endwalls. Each endwall is joined to a corresponding end of an airfoil of the stationary blade. Stationary blades can also include passages or other features for circulating cooling fluids which absorb heat from operative components of the turbomachine.

In order to operate in extreme temperature settings, the airfoil and endwalls need to be cooled. For example, in some settings, a cooling fluid is pulled from the wheel space and directed to internal endwalls of the stationary blade for cooling. In contrast, in many gas turbine applications, later stage nozzles may be fed cooling fluid, e.g., air, extracted from a compressor of the gas turbine. Outer diameter endwalls may receive the cooling fluid directly, while inner diameter endwalls may receive the cooling fluid after it is routed through the airfoil from the outer diameter. In addition to the effectiveness of cooling, the structure of a stationary blade and its components can affect other factors such as manufacturability, ease of inspection, and the durability of a turbomachine.

BRIEF DESCRIPTION OF THE INVENTION

A first aspect of the present disclosure provides a cooling structure for a stationary blade, the cooling structure comprising: an airfoil having a cooling circuit therein; an endwall coupled to a radial end of the airfoil, relative to a rotor axis of a turbomachine; a chamber positioned within the endwall for receiving a cooling fluid from the cooling circuit and including an upstream region and a downstream region therein, wherein the cooling fluid absorbs heat from the endwall, and a temperature of the cooling fluid in the upstream region is lower than a temperature of the cooling fluid in the downstream region; a first passage within the endwall fluidly connecting the upstream region of the chamber to a wheel space positioned between the endwall and the turbine wheel, wherein a first portion of the cooling fluid in the upstream region passes through the first passage; and a second passage within the endwall fluidly connecting the downstream region of the chamber to the wheel space, wherein a second portion of the cooling fluid in the downstream region passes through the second passage, and a remainder portion of the cooling fluid bypasses the first passage and the second passage without entering the wheel space.

A second aspect of the present disclosure provides a cooling structure for a stationary blade, the cooling structure comprising: an airfoil having a cooling circuit therein; an endwall coupled to a radial end of the airfoil, relative to a rotor axis of a turbomachine; a chamber positioned within the endwall for receiving a cooling fluid and including an upstream region and a downstream region therein, wherein the cooling fluid absorbs heat from the endwall, and a temperature of the cooling fluid in the upstream region is lower than a temperature of the cooling fluid in the downstream region; a first passage within the endwall fluidly connecting the upstream region of the chamber to a shroud space positioned between the endwall and the turbine shroud, wherein a first portion of the cooling fluid in the upstream region passes through the first passage; and a second passage within the endwall fluidly connecting the downstream region of the chamber to the shroud space, wherein a second portion of the cooling fluid in the downstream region passes through the second passage, and a remainder portion of the cooling fluid bypasses the first passage and the second passage to enter the cooling circuit of the airfoil.

A third aspect of the present disclosure provides a stationary blade including: an airfoil having a cooling circuit therein; a first endwall coupled to an a radial end of the airfoil, relative to a rotor axis of a turbomachine; a first chamber positioned within the first endwall for receiving a cooling fluid, the first chamber being in fluid communication with the cooling circuit, wherein the cooling fluid absorbs heat from the first endwall, and a temperature of the cooling fluid increases within the first chamber; a plurality of shroud passages within the first endwall fluidly connecting the first chamber to a shroud space positioned between the first endwall and a turbine shroud, wherein a temperature of the cooling fluid in at least one of the plurality of shroud passages is lower than a temperature of the cooling fluid in another one of the plurality of shroud passages, and wherein a remainder portion of the cooling fluid bypasses each of the plurality of shroud passages to enter the cooling circuit of the airfoil; a second endwall coupled to an opposing radial end of the airfoil; a second chamber positioned within the second endwall for receiving the cooling fluid from the cooling circuit of the airfoil, wherein the cooling fluid absorbs heat from the second endwall, and the temperature of the cooling fluid increases when passing within second chamber; and a plurality of wheel passages within the second endwall fluidly connecting the second chamber to a wheel space positioned between the second endwall and a turbine wheel, wherein the temperature of the cooling fluid in at least one of the plurality of wheel passages is lower than a temperature of the cooling fluid in another one of the plurality of wheel passages.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
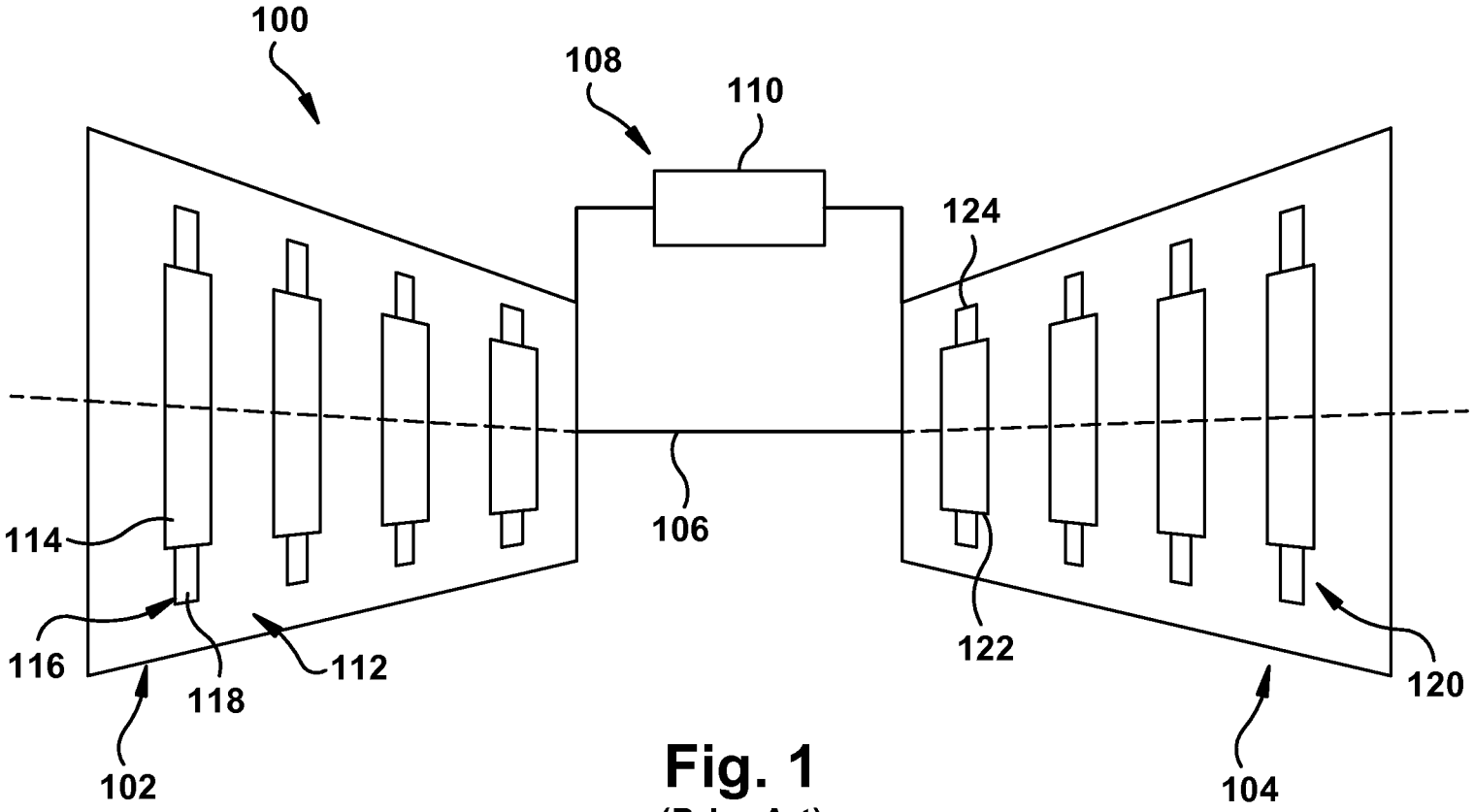
Fig. 1 (Prior Art)
FIG. 1 shows a schematic view of a conventional turbomachine.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Embodiments of the present disclosure relate generally to cooling structures for stationary blades. In particular, embodiments of the present disclosure provide for the controlled cooling and pressurization, also known as "tuning," of spaces positioned radially between a stationary blade and a shroud of a turbomachine and/or a stationary blade and a wheel of a turbine system. For example, embodiments of the present disclosure provide for a chamber positioned within an endwall located at a radial end of an airfoil. The chamber can include two or more passages extending through the endwall which connect the chamber to a wheel space or shroud space. Portions of the cooling fluids in the chamber can flow through the passages to further cool the wheel or shroud spaces.

As discussed herein, aspects of the invention relate generally to cooling structures for a stationary blade. In particular, embodiments of the present disclosure can include an airfoil positioned substantially radially, relative to a rotor axis of a turbomachine, between two endwalls. Each endwall, in turn, may separate the airfoil from a shroud of the turbomachine or a wheel of the turbomachine. The airfoil can include a cooling circuit which is in fluid communication with a chamber positioned within the endwall. A cooling fluid can flow through the chamber, either into the cooling circuit of the airfoil (e.g., for chambers positioned within a radially outer endwall) or out of the cooling circuit of the airfoil (e.g., for chambers positioned within a radially inner endwall). The chamber can include a first passage connecting an upstream region of the chamber to either a wheel space or a shroud space of the turbomachine. A portion of the cooling fluid which bypasses the first passage can absorb thermal energy from the endwall, e.g., through perimeter walls and/or thermally conductive fixtures within the chamber, before reaching a second passage connecting a downstream region of the chamber to the wheel space or shroud space. A different portion of the cooling fluid can enter the second passage and provide cooling to the wheel or shroud space, such that the second passage provides cooling fluid with a different temperature and pressure from the cooling fluid passing through the first passage. A remainder portion of the cooling fluid can bypass the first passage and the second passage to reach other downstream chambers and/or components in need of cooling.

Spatially relative terms, such as "inner," "outer," "underneath," "below," "lower," "above," "upper," "inlet," "outlet," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "underneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As indicated above, the disclosure provides a cooling structure for a stationary blade of a turbomachine. In one embodiment, the cooling structure may route cooling air from a chamber positioned within an endwall to a space between the stationary blade and either a shroud or a wheel of the turbomachine. FIG. 1 shows a turbomachine 100 that includes a compressor portion 102 operatively coupled to a turbine portion 104 through a shared compressor/turbine shaft 106. Compressor portion 102 is also fluidically connected to turbine portion 104 through a combustor assembly 108. Combustor assembly 108 includes one or more combustors 110. Combustors 110 may be mounted to turbomachine 100 in a wide range of configurations including, but not limited to, being arranged in a can-annular array. Compressor portion 102 includes a plurality of compressor rotor wheels 112. Rotor wheels 112 include a first stage compressor rotor wheel 114 having a plurality of first stage compressor rotor blades 116 each having an associated airfoil portion 118. Similarly, turbine portion 104 includes a plurality of turbine rotor wheels 120 including a first stage turbine wheel 122 having a plurality of first stage turbine rotor blades 124. In accordance with an exemplary embodiment, a stationary blade 200 (FIG. 3) with a cooling structure according to embodiments of the present disclosure can provide cooling to endwalls and airfoils located in, e.g., turbine section 104. It will be understood, however, that embodiments of stationary blade 200 and the various cooling structures described herein may be positioned in other components or areas of turbomachine 100.

Figure 2:
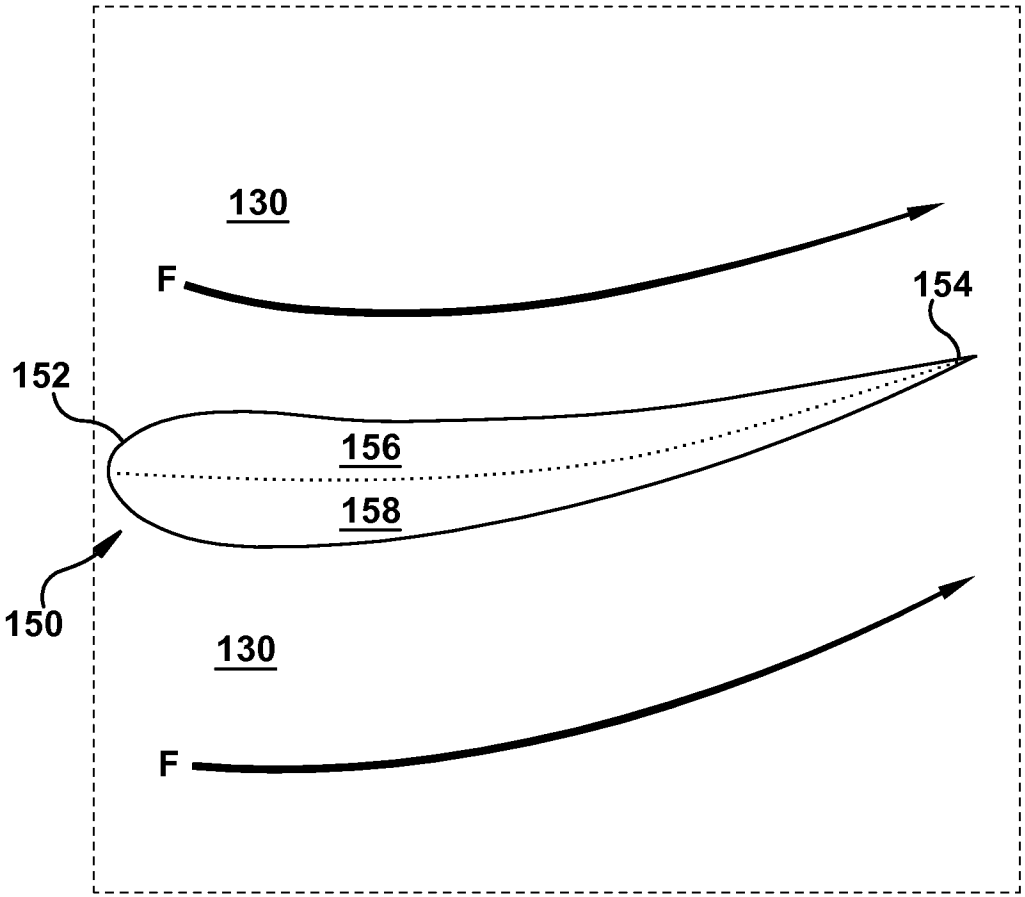
FIG. 2 is a cross-sectional view of an airfoil positioned between two turbine rotor blades according to embodiments of the present disclosure.

Turning to FIG. 2, a cross-section of an airfoil 150 having a flow path 130 for operating fluids therein is shown. Airfoil 150 can be part of stationary blade 200 (FIG. 3), and can further include the components and/or points of reference described herein. The locations on airfoil 150 identified in FIG. 2 and discussed herein are provided as examples and not intended to limit possible locations and/or geometries for airfoils 150 according to embodiments of the present disclosure. The placement, arrangement, and orientation of various sub-components can change based on intended use and the type of power generation system in which cooling structures according to the present disclosure are used. The shape, curvatures, lengths, and/or other geometrical features of airfoil 150 can also vary based on the application of a particular turbomachine 100 (FIG. 1). Airfoil 150 can be positioned between successive turbine rotor blades 124 (FIG. 1) of a power generation system such as turbomachine 100.

Airfoil 150 can be positioned downstream of one turbine rotor blade 124 (FIG. 1) and upstream of another, subsequent turbine rotor blade 124 (FIG. 1) in a flow path for an operative fluid. Fluids can flow across airfoil 150, e.g., along path(s) F, while traveling from one turbine rotor blade 124 (FIG. 1) to another. A leading edge 152 of airfoil 150 can be positioned at an initial point of contact between operative fluid in flow path 130 and airfoil 150. A trailing edge 154, by contrast, can be positioned at the opposing side of airfoil 150. In addition, airfoil 150 can include a pressure side surface 156 and/or suction side surface 158 distinguished by a transverse line which substantially bisects leading edge 152 and extends to the apex of trailing edge 154. Pressure side surface 156 and suction side surface 158 can also be distinguished from each other based on whether fluids in flow path 130 exert positive or negative resultant pressures against airfoil 150. A portion of flow path 130 positioned adjacent to suction side surface 158 and trailing edge 154 can be known as and referred to as a "high mach region" of airfoil 150, based on fluids flowing at a higher speed in this area relative to other surfaces of airfoil 150.

Figure 3:
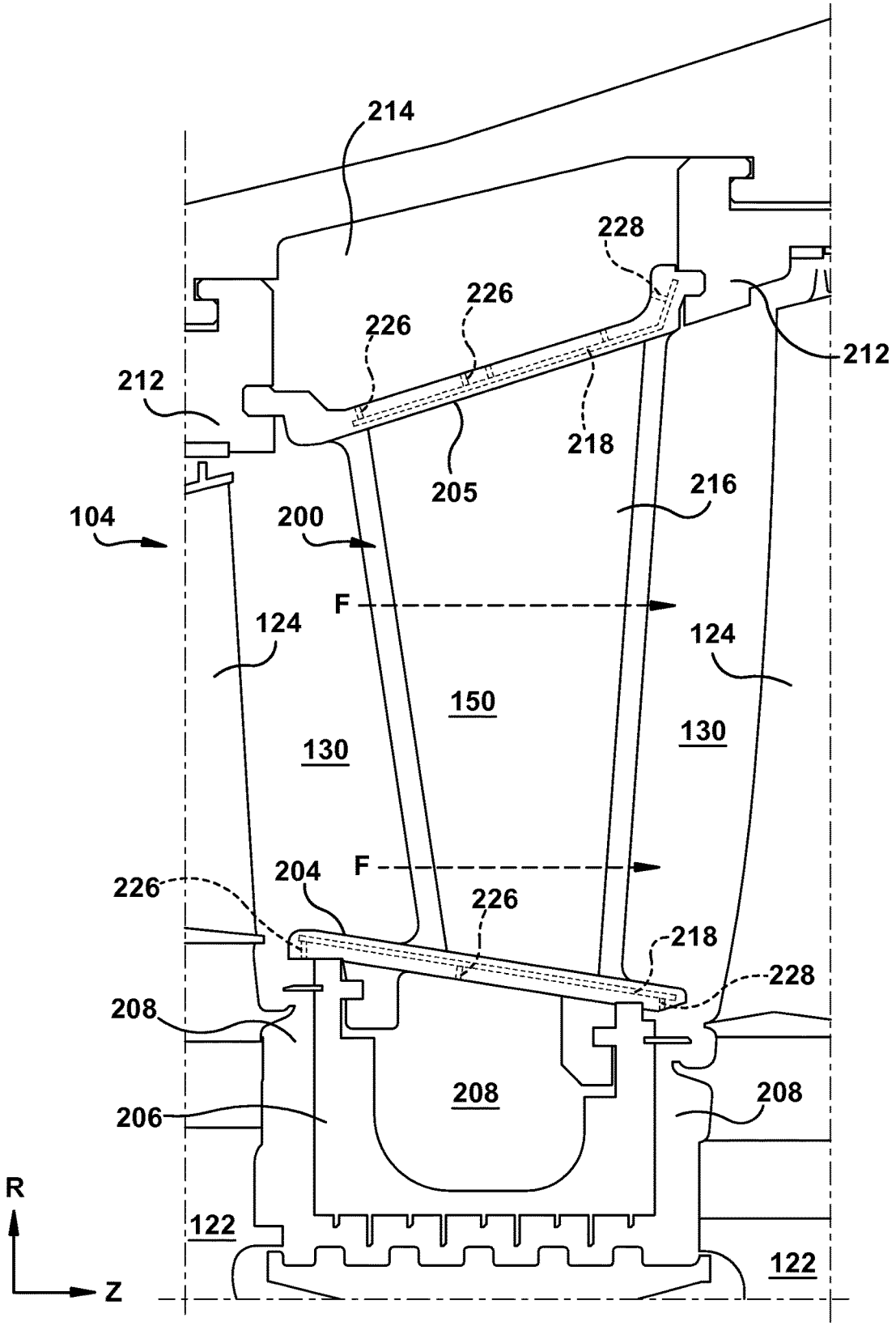
FIG. 3 is a cross-sectional view of an airfoil, a pair of endwalls, a wheel, and a shroud in a turbine section of a turbomachine.

Turning to FIG. 3, a cross section of flow path 130 past a stationary blade 200 positioned within turbine portion 104 is shown. An operative fluid (e.g., hot combustion gasses, steam, etc.) can flow (e.g., along flow lines F) through flow path 130, to reach further turbine rotor blades 124 as directed by the position and contours of stationary blade 200. Turbine portion 104 is shown extending along a rotor axis Z of turbine wheel 122 (e.g., coaxial with shaft 106 (FIG. 1)), and with a radial axis R extending outwardly therefrom. Stationary blade 200 can include airfoil 150 oriented substantially along (i.e., extending in a direction parallel with or at most approximately ten degrees of) radial axis R. Although one stationary blade 200 is shown in the cross-sectional view of FIG. 3, it is understood that multiple turbine rotor blades 124 and stationary blades 200 can extend radially from turbine wheel 122, e.g., extending laterally into and/or out of the plane of the page. An airfoil 150 of stationary blade 200 can include two endwalls 204, 205. One endwall 204 can be coupled to an inner radial end of airfoil 150 positioned on a turbine diaphragm 206, and another endwall 205 can be coupled to an outer, opposing radial end of airfoil 150.

The radially inner endwall 204 can be separated from turbine wheel 122 or diaphragm 206 by spacing therebetween. Specifically, the spacing between endwall 204 and turbine wheel 122 can be known as a "turbine wheel space" while the spacing between endwall 204 and diaphragm 206 can be known as a "diaphragm space." These areas of spacing are referred to collectively herein as wheel space 208, and can refer to either or both regions of spacing (i.e., between endwall 204 and turbine wheel 122 or between endwall 204 and diaphragm 206). In particular wheel space 208 can extend radially from, e.g., approximately the position of endwall 204 to space adjacent to and/or below diaphragm 206. A shroud 212 can be located at a radial end of stationary blade 200. A shroud space 214 can separate from stationary blade 200 from shroud 212. During operation, the flow of hot combustion gases travelling along flow lines F can transfer heat to turbine wheel 122 and/or shroud 212. In addition, wheel space 208 and/or shroud space 214 can increase in temperature during operation due to heat transfer from stationary blade 200 or directly from diverted operating fluids entering wheel space 208 and/or shroud space 214.

Airfoil 150 of stationary blade 200 can include a cooling circuit 216 therein. Cooling circuit 216, which can be in the form of an impingement cavity, can circulate a cooling fluid through a partially hollow interior of airfoil 150 between two endwalls 204, 205 of stationary blade 200. An impingement cooling circuit generally refers to a cooling circuit structured to create a film of cooling fluid about a portion of a cooled component (e.g., a transverse radial member of airfoil 150), thereby diminishing the transfer of thermal energy from substances outside the cooled component to an interior volume of the cooled component. Cooling fluids in cooling circuit 216 can originate from and/or flow to a chamber 218 (identified as one of two chambers 218A, 218B, herein) positioned within one endwall 204 or two radially separated endwalls 204, 205. Cooling fluids in chamber(s) 218 which have not traveled through cooling circuit 216 can be known as "pre-impingement" cooling fluids, while cooling fluids in chamber(s) 218 which have previously traveled through cooling circuit 216 can be known as "post-impingement" cooling fluids. Among other things, embodiments of the present disclosure allow for the use and/or repurposing of cooling air in chamber(s) 218, at a variable number of temperatures and pressures, as cooling fluid routed to wheel space 208 and/or shroud space 214.

Figure 4:
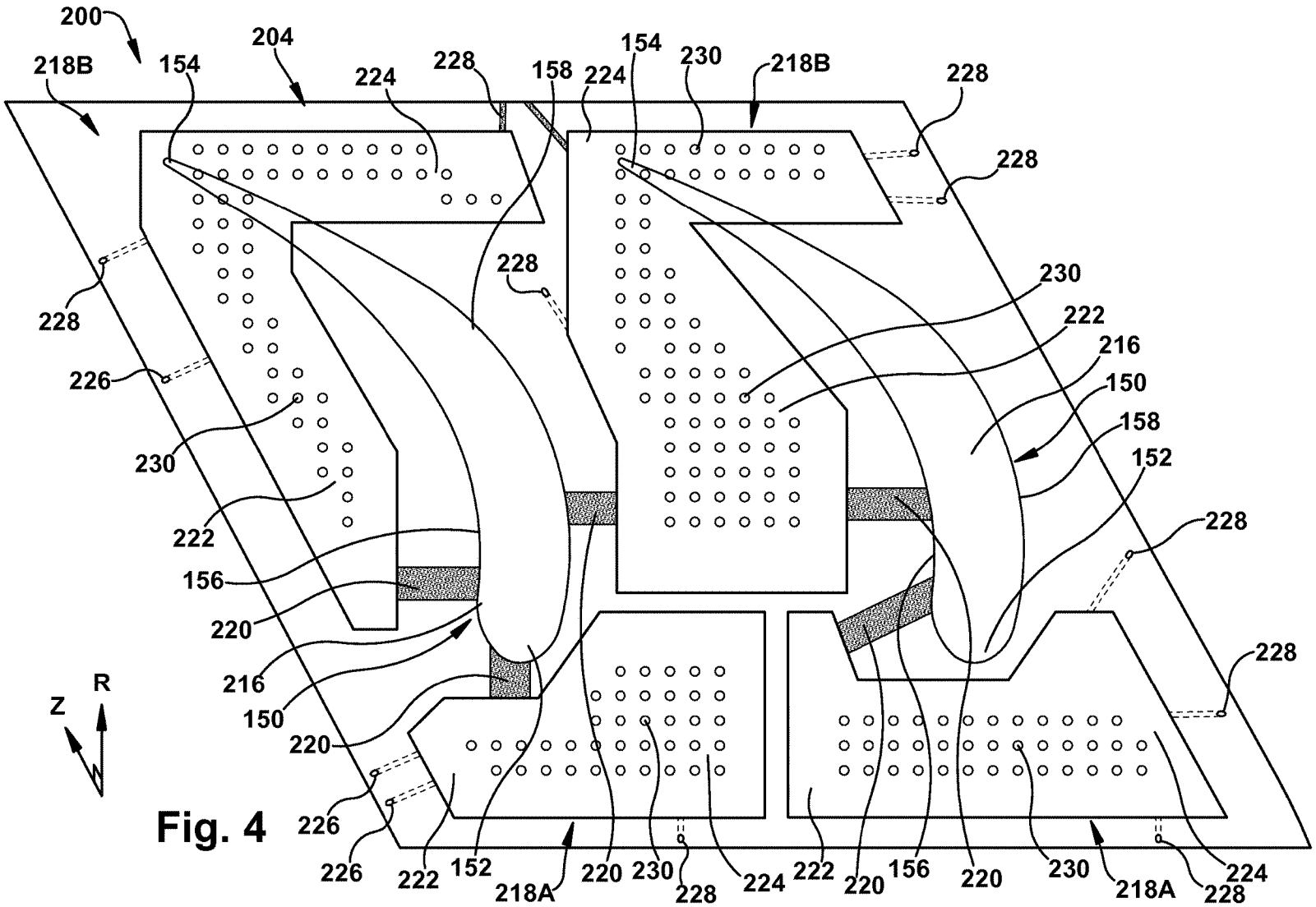
FIG. 4 is a perspective partial view of a cooling structure for a stationary blade according to embodiments of the present disclosure.

Turning to FIG. 4, a cut-away illustration of one endwall 204 in stationary blade 200 with four chambers (two fore chambers 218A, two aft chambers 218B) therein is shown. Although radially inner endwall 204 is shown by example in FIG. 4, it is understood that the various features and components described herein can also be present in radially outer endwall 205 of stationary blade 200. That is, the only substantial difference between these two alternatives can be their radial positions relative to stationary blade 200 (FIG. 3). Although four chambers 218A, 218B are shown by example in FIG. 4 and in fluid communication with cooling circuits 216 of two airfoils 150 coupled to one endwall 204, it is understood that any conceivable number of airfoils 150 and/or chambers 218 can be used. In an embodiment, endwall 204 of stationary blade 200 can include one or more fore chambers 218A, optionally positioned proximal to leading edge 152 of airfoil 150. Endwall 204 of stationary blade 200 can also include one or more aft chambers 218B each positioned downstream of fore chamber(s) 218A and optionally proximal to trailing edge 154 of airfoil 150. Both fore chamber(s) 218A and aft chamber(s) 218B can be displaced from airfoil 150 along radial axis R (i.e., "radially displaced"), such that cooling fluids in chambers 218A, 218B pass beneath airfoil 150.

In addition, as shown in FIG. 4, airfoils 150 can be provided as a pair of airfoils extending substantially radially from endwall 204, one or both of which can include cooling circuit(s) 216 therein. Although two airfoils 150 are depicted as coupled to endwall 204 in FIG. 4 (i.e., in a doublet turbine nozzle configuration) by way of example, it is understood that any desired number of airfoils 150 may be coupled to endwall 204 to suit varying turbomachine designs and applications. Each chamber(s) 218A, 218B can be in fluid communication with one of the pair of airfoils 150. Chambers 218A, 218B can be in fluid communication with one cooling circuit 216 or any other conceivable fluid connection between cooling circuit(s) 216 and chamber(s) 218A, 218B. An opening 220 can provide thermal communication between cooling circuit(s) 216 and chamber(s) 218A, 218B to permit cooling fluids to flow into or out of chamber(s) 218 during operation as either an inlet or an outlet. Chamber(s) 218A, 218B can be positioned within endwall 204, which in turn can be composed of a thermally conductive material (e.g., a metal, a thermally conductive synthetic material, a composite material, etc.), such that cooling fluid traveling through chamber(s) 218A, 218B absorbs heat from endwall 204. The transfer of heat from endwall 204 to cooling fluid within chamber(s) 218A, 218B can cause the temperature and pressure of cooling fluids to gradually increase while traveling therethrough. More specifically, cooling fluids in a region of chamber(s) 218A, 218B positioned downstream from other regions or chambers can have a higher temperature and lower pressure, due to the transfer of heat from operating fluids to the cooling fluid through endwall 204.

In one embodiment, each chamber(s) 218A, 218B can include an upstream region 222 and a downstream region 224 therein. Generally, the term "upstream" refers to a reference path extending in the direction opposite to the resultant direction in which cooling fluids pass through chamber(s) 218A, 218B. The term "downstream" refers to a reference path extending in the same direction as the resultant direction in which cooling fluids pass through chamber(s) 218A, 218B. Downstream region 224 is generally distinguished from upstream region 224 by having significantly warmer cooling fluids therein, and may be only partially distinguishable by its physical location within endwall 204. In an alternative embodiment, in which fore chamber(s) 218A is fluidly connected to aft chamber(s) 218B, fore chamber(s) 218A can function as at least one upstream region 222 and aft chamber(s) 218B can function as at least one downstream region 224. Furthermore, it is understood that fore chamber(s) 218A can be fluidly connected to aft chamber(s) 218B with each chamber(s) 218A, 218B having respective upstream regions 222 and downstream regions 224 therein. Each upstream region 222 is distinguishable from a corresponding downstream region 224 based on differences between the temperature and pressure of cooling fluids therein. Furthermore, as shown in FIG. 4, upstream region 222 can be positioned proximal to leading edge 152 of airfoil 150 (e.g., separated from the leading edge by less than its separation distance from trailing edge 154), and downstream region 224 can be positioned proximal to trailing edge 154 of airfoil 150.

An initial temperature of cooling fluids in each chamber 218, i.e., in upstream region(s) 222, can be between approximately, e.g., 315 degrees Celsius (° C.) and approximately 427° C. A temperature of cooling fluids in subsequent chambers 218 or subsequent regions of one chamber 218, i.e., in downstream region(s) 224, can be between, e.g., approximately 815° C. and approximately 870° C. Cooling fluids in upstream region(s) 222 can have a pressure of, e.g., between approximately 1,000 kilopascals (kPa) and approximately 1,380 kPa, and fluids in downstream region(s) 224 can have a pressure of between approximately 860 kPa and approximately 1,200 kPa. Regardless of the pressure values in a particular application, the pressure of cooling fluids in downstream region(s) 224 can be between approximately five percent and approximately twenty percent of their pressure in upstream region(s) 222. As used herein, the term "approximately" in relation to a specified numerical value (including percentages of base numerical values) can include all values within ten percentage points of (i.e., above or below) the specified numerical value or percentage, and/or all other values which cause no substantial operational difference between the modified value and the enumerated value. The term approximately can also include other specific values or ranges where specified herein.

Figure 5:
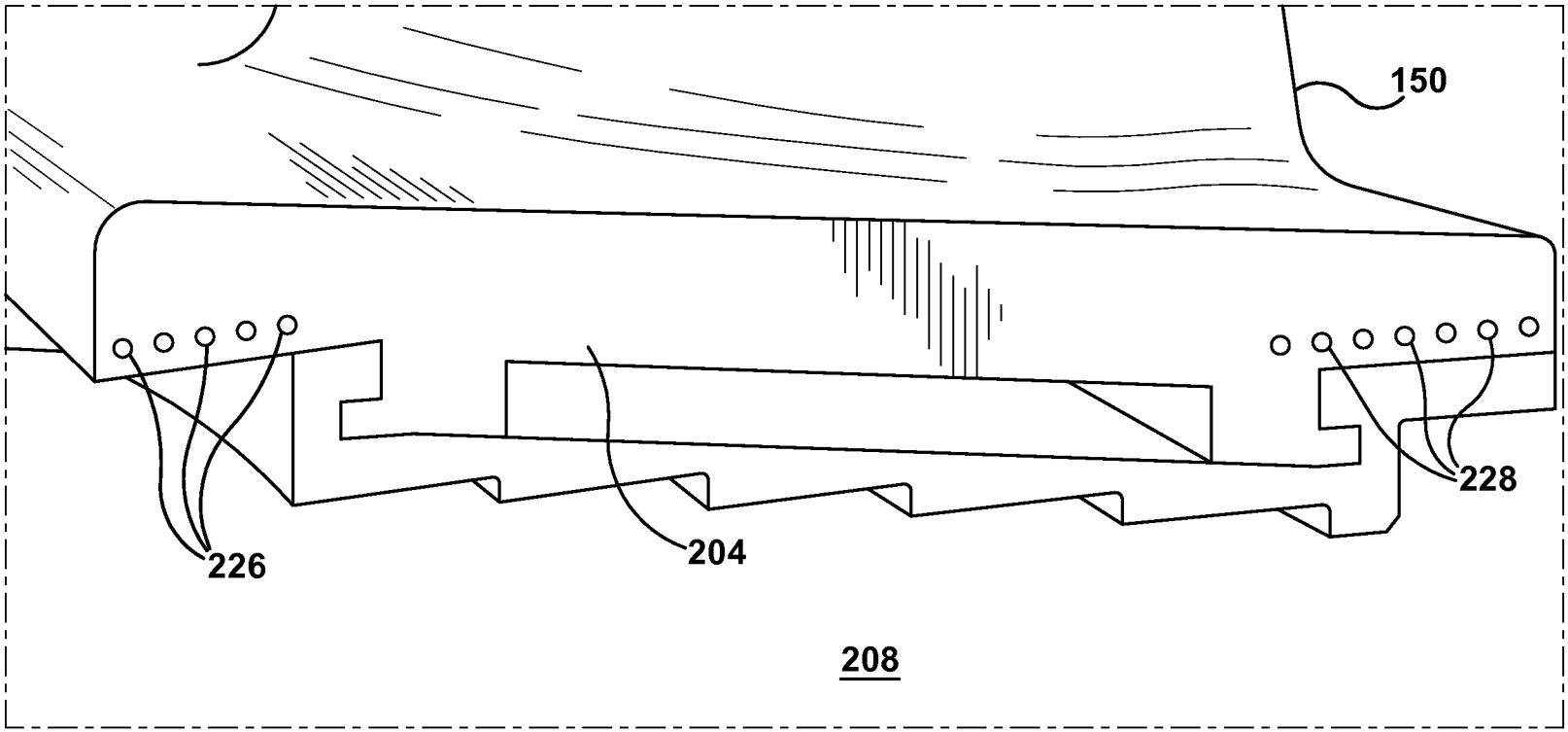
FIG. 5 is another cross-sectional view of a wheel or shroud space with passages connected to a chamber of a cooling structure according to embodiments of the present disclosure.

Referring to FIGS. 4 and 5 together, endwalls 204, 205 can include one or more first passages 226 positioned therein, each of which can connect a respective upstream region 224 to wheel space 208 or shroud space 214 (FIG. 3). Although FIG. 5 shows wheel space 208 positioned between turbine wheel 122 and endwall 204, 205, it is understood that first passage 226 can additionally or alternatively connect respective upstream region(s) 224 of chamber(s) 218A, 218B to shroud space 214. During operation, a first portion of cooling fluid in upstream region 224 of chamber(s) 218 can flow into first passage(s) 226 to enter wheel space 208 or shroud space 214. Each first passage 226 can be sized to divert only a portion of cooling fluid in chamber(s) 218 (e.g., up to approximately 50%), such that a majority of cooling fluid in chamber(s) 218 bypasses first passage(s) 226 and travels to downstream region(s) 224.

In addition to first passage(s) 226, endwall 204, 205 can also include one or more second passages 228 positioned therein. Each second passage 228 can connect a respective downstream region 224 to wheel space 208 (FIG. 3) or shroud space 214. As turbomachine 100 (FIG. 1) operates, a second portion of cooling fluid in downstream region 224 of chamber(s) 218, which previously bypassed first passage(s) 226, can enter second passage(s) 228 and thereby travel to wheel space 208 or shroud space 214. The portion of cooling fluids entering second passage(s) 228 can be, e.g., 50% or more of the total cooling fluid flow through chamber(s) 218. It is also understood that, in alternative embodiments, a majority of cooling air (e.g., approximately 50% or more) can flow through first passage(s) 226, while a minority portion of cooling air (e.g., up to approximately 50%) can flow through second passages 228 in alternative embodiments. Second passage(s) 228 can fluidly connect downstream region(s) 224 to different locations of wheel space 208 (FIG. 3) or shroud space 214 from where first passage(s) 226 fluidly connect wheel or shroud spaces 208, 214 to upstream region(s) 222. In the case of wheel space 208, the different locations can include, e.g., areas of wheel space 208 positioned between endwall 204 and turbine wheel 122 (FIGS. 1, 3) or between endwall 204 and diaphragm 206 (FIG. 3). In any event, the position of each first and second passage 226, 228 can allow wheel or shroud spaces 208, 214 to be variably cooled, with locations subject to higher temperature fluids receiving lower temperature cooling fluids from first passage(s) 226. Similarly, locations within wheel or shroud space(s) 208, 214 with lower cooling requirements can receive higher temperature cooling fluids from second passage(s) 228.

Each second passage 228 can also be sized to divert only a portion of cooling fluid in chamber(s) 218 therethrough such that a remainder portion of cooling fluid in chamber(s) 218 bypasses first and second passage(s) 226, 228. The remainder portion of the cooling fluid which bypasses first and second passage(s) 226, 228 can continue to other downstream chambers 218 and/or other components in fluid communication with chamber(s) 218 or endwall(s) 204, 205 of stationary blade 200. In any event, this remainder portion of cooling fluid can flow to downstream components, chambers, fixtures, etc., without entering wheel space 208 or shroud space 214.

It is understood that the present disclosure can be provided in still further embodiments. For example, stationary blade 200 can include two endwalls 204, 205 each including chamber(s) 218 therein fluidly connected to each other by cooling circuit 216 of airfoil 150. A cooling fluid from an external source can first pass through chamber(s) 218 of a radially outer endwall 205, before passing through cooling circuit 216 as an impingement fluid, and then entering chamber(s) 218 of a radially inner endwall 204. A portion of cooling fluid in each chamber 218 can pass through first and second passages 226, 228, to enter wheel space 208 or shroud space 214. More specifically, first and second passages 226, 228 from the radially outer endwall 205 can function as shroud space passages, while first and second passages 226, 228 from the radially inner endwall 204 can function as wheel space passages. Each chamber 218 of stationary blade 200 can also include one or more additional structures and/or features described elsewhere herein where applicable, e.g., additional airfoils 150 extending radially between the same two endwalls 204, 205, the use of fore chambers 218A and aft chambers 218B proximal to leading edge 152 and trailing edge 154 of airfoil 150, respectively, etc.

Figure 6:
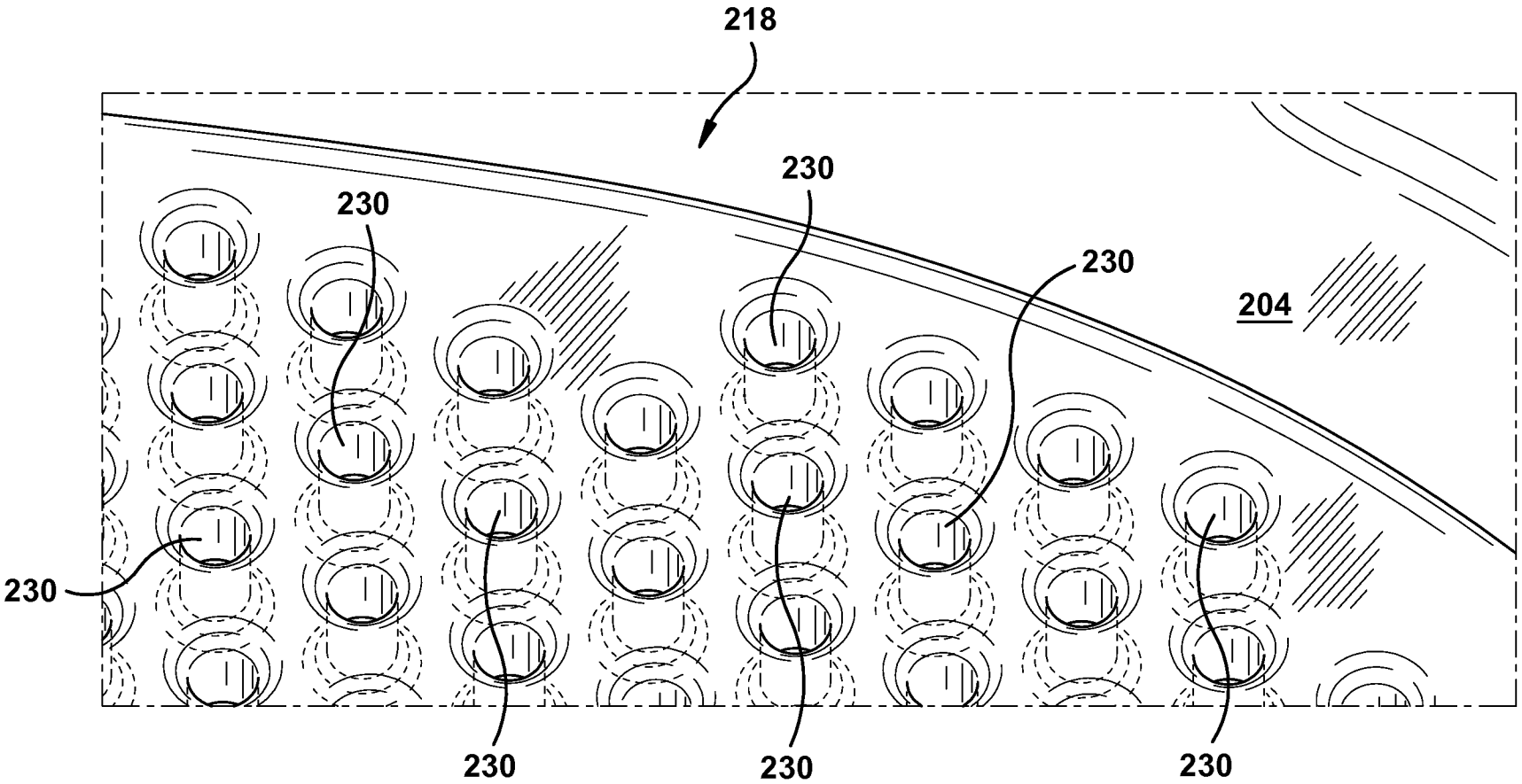
FIG. 6 provides an enlarged cross-sectional view of a thermally conductive fixture within a cooling structure according to embodiments of the present disclosure.

Referring to FIGS. 4 and 6 together, embodiments of the present disclosure can include any number of thermally conductive fixtures ("fixtures") 230, such as a pedestal, within chamber(s) 218 (e.g., within fore section 222 or aft section 224) for transferring heat from stationary blade 200 to cooling fluids within chamber(s) 218. More specifically, each fixture 230 can transmit heat from endwall 204 to cooling fluids therein by increasing the contact area between cooling fluids passing through chamber(s) 218 and the material composition of endwall(s) 204, 205. Fixtures 230 can be provided as any conceivable fixture for increasing the contact area between cooling fluids and thermally conductive surfaces, and as examples can be in the form of pedestals, dimples, protrusions, pins, walls, and/or other fixtures of other shapes and sizes. Furthermore, fixtures 230 can take a variety of shapes, including those with cylindrical geometries, substantially pyramidal geometries, irregular geometries with four or more surfaces, etc. In any event, one or more thermally conductive fixtures 230 can be positioned within chamber(s) 218 in a location of the cooling fluid flow path located downstream of upstream region(s) 222 and first passage(s) 226, and upstream of downstream region(s) 224 and second passage(s) 228. The positioning of thermally conductive fixtures 230 between first and second passage(s) 230 can improve thermal communication between endwall(s) 204, 205 and cooling fluids therein and cause a greater temperature differential between the temperature of cooling air delivered through first passage(s) 226 and second passage(s) 228.

Figure 7:
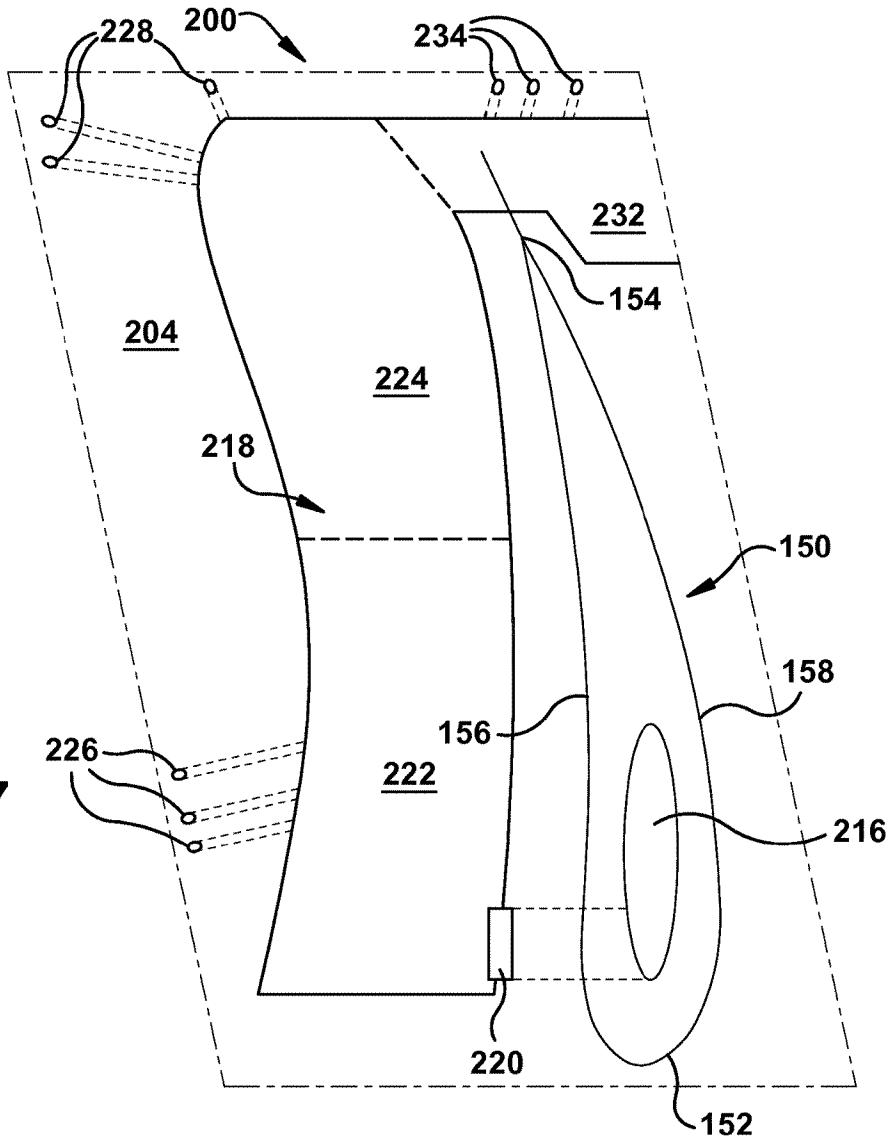
FIG. 7 is a cross-sectional view of an example chamber in a cooling structure for a stationary blade according to embodiments of the present disclosure.

Turning to FIG. 7, a simplified cross-sectional view of chamber 218 in stationary blade 200 is shown according to another embodiment. As discussed elsewhere herein, upstream region 222 of aft chamber(s) 218B can include a group of first passages 226 fluidly connecting upstream region 222 to wheel space 208 (FIGS. 3, 5) or shroud space 214 (FIG. 3). Downstream region 224 of chamber(s) 218 can similarly include a group of second passages 228 fluidly connecting downstream region 224 to wheel space 208 or shroud space 214 (FIG. 3). In addition, chamber(s) 218 can optionally include a terminal region 232 and a plurality of third passages 234 fluidly connecting terminal region 232 to wheel space 208, shroud space 214, or another component which receives cooling fluids from stationary blade 200. The temperature of cooling fluids in terminal region 232 and third passages 234 can be greater than the temperature of cooling fluids in both upstream region 222 and downstream region 224, with a corresponding lower pressure than cooling fluids in upstream and downstream regions 222, 224. Terminal region 234 can be located, e.g., proximal to trailing edge 154 and/or pressure side surface 156 of airfoil 150. The addition of third passages 234 can provide, e.g., greater variability of cooling temperatures for wheel space 208 or shroud space 214 by providing the highest temperature cooling fluids within endwall(s) 204, 205 (FIGS. 3-5) to locations where the least amount of cooling is desired. Third passages 234 can also provide a route through which a remainder portion of cooling air passes from chamber(s) 218 to other areas of a turbomachine (e.g., intersegment gaps, shroud components, etc.).

Embodiments of the present disclosure can provide several technical and commercial advantages. For example, embodiments of the present disclosure provide for the routing of cooling fluids of multiple temperatures and pressures to various locations within wheel or shroud spaces of a turbomachine, and are not limited to the routing of pre-impingement fluids at one temperature and post-impingement fluids at another temperature. The greater number of temperatures allows for fine tuning of cooling requirements in wheel spaces and shroud spaces, thereby reducing the total amount of cooling air needed for the cooling of these components. Resulting benefits of the cooling structures described herein can include, among other things, a reduction in wasted heat potential, lower leakages normally associated with higher pressure cooling airs, and greater turbomachine efficiency based on these improvements.

The apparatus and method of the present disclosure is not limited to any one particular gas turbine, combustion engine, power generation system or other system, and may be used with other power generation systems and/or systems (e.g., combined cycle, simple cycle, nuclear reactor, etc.). Additionally, the apparatus of the present invention may be used with other systems not described herein that may benefit from the increased operational range, efficiency, durability and reliability of the apparatus described herein. In addition, the various injection systems can be used together, on a single nozzle, or on/with different nozzles in different portions of a single power generation system. Any number of different embodiments can be added or used together where desired, and the embodiments described herein by way of example are not intended to be mutually exclusive of one another.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cooling structure for a stationary blade, the cooling structure comprising:

an airfoil having a cooling circuit therein;

an endwall coupled to a radial end of the airfoil, relative to a rotor axis of a turbomachine;

a chamber positioned within the endwall for receiving a cooling fluid from the cooling circuit and including an upstream region and a downstream region therein, wherein the cooling fluid absorbs heat from the endwall, and a temperature of the cooling fluid in the upstream region is lower than a temperature of the cooling fluid in the downstream region;

a first passage within the endwall fluidly connecting the upstream region of the chamber to a wheel space positioned radially between the endwall and the turbine wheel, wherein a first portion of the cooling fluid in the upstream region passes through the first passage, and wherein the first passage is oriented radially with respect to the rotor axis of the turbomachine;

a second passage within the endwall fluidly connecting the downstream region of the chamber to the wheel space positioned radially between the endwall and the turbine wheel, wherein a second portion of the cooling fluid in the downstream region passes through the second passage, and wherein the second passage is oriented radially with respect to the rotor axis of the turbomachine; and a third passage within the endwall fluidly connecting the downstream region of the chamber to a region other than the wheel space, such that the third passage transmits a remainder portion of the cooling fluid which bypasses the first passage and the second passage to the region other than the wheel space, without entering the wheel space.

2. The cooling structure of claim 1, further comprising a thermally conductive fixture within the chamber for transmitting heat from the endwall to the cooling fluid.

3. The cooling structure of claim 2, wherein the first passage is positioned upstream of the thermally conductive fixture, and the second passage is positioned downstream of the thermally conductive fixture.

4. The cooling structure of claim 1, wherein the first passage fluidly connects the upstream region of the chamber to a first location in the wheel space, and the second passage fluidly connects the downstream region of the chamber to a second location in the wheel space.

5. The cooling structure of claim 1, wherein the upstream region of the chamber is positioned proximal to a leading edge of the airfoil, and the downstream region of the chamber is positioned proximal to a trailing edge of the airfoil.

6. The cooling structure of claim 1, wherein the chamber further includes a fore chamber and an aft chamber positioned within the endwall, wherein the fore chamber is positioned proximal to a leading edge of the airfoil, the aft chamber is positioned proximal to a trailing edge of the airfoil, the upstream region is positioned within the fore chamber, and the downstream region is positioned within the aft chamber.

7. The cooling structure of claim 1, wherein a temperature of the cooling fluid in the third passage is different from the temperature of the cooling fluid in the upstream region and the temperature of the cooling fluid in the downstream region of the chamber.

8. The cooling structure of claim 1, wherein the airfoil includes a plurality of airfoils extending from the endwall, and one of the plurality of airfoils includes the cooling circuit in fluid communication with the chamber.

9. A cooling structure for a stationary blade, the cooling structure comprising:

an airfoil having a cooling circuit therein;

an endwall coupled to a radial end of the airfoil, relative to a rotor axis of a turbomachine;

a first chamber positioned within the endwall for receiving a cooling fluid, wherein the cooling fluid in the first chamber absorbs heat from a first portion of the endwall, and wherein a first portion of the cooling fluid from the cooling circuit enters the first chamber;

a first passage within the endwall fluidly connecting the first chamber to a wheel space positioned radially between the endwall and the turbine wheel, wherein the first passage is oriented radially with respect to the rotor axis of the turbomachine;

a second chamber positioned within the endwall for receiving the cooling fluid, wherein the cooling fluid in the second chamber absorbs heat from a second portion of the endwall, and wherein a second portion of the cooling fluid from the cooling circuit enters the second chamber;

a second passage within the endwall fluidly connecting the second chamber to the wheel space positioned radially between the endwall and the turbine wheel, wherein the second passage is oriented radially with respect to the rotor axis of the turbomachine; and a third passage within the endwall fluidly connecting the downstream region of the chamber to a region other than the wheel space, such that the third passage transmits a remainder portion of the cooling fluid which bypasses the first passage and the second passage to the region other than the wheel space, without entering the wheel space.

10. The cooling structure of claim 9, further comprising a thermally conductive fixture within at least one of the first chamber and the second chamber for transmitting heat from one of the first portion and the second portion of the endwall to the cooling fluid.

11. The cooling structure of claim 9, wherein one of a temperature and a pressure of the cooling air in the first passage is different from one of a respective temperature and a respective pressure of the cooling fluid in the second passage.

12. The cooling structure of claim 9, wherein the first chamber further includes a fore chamber and an aft chamber positioned within the first portion of the endwall, and wherein the fore chamber is positioned proximal to a leading edge of the airfoil, and the aft chamber is positioned proximal to a trailing edge of the airfoil.

13. The cooling structure of claim 9, wherein the airfoil comprises one of a plurality of airfoils extending from the endwall, and one of the plurality of airfoils includes the cooling circuit in fluid communication with the first and second chambers.

14. The cooling structure of claim 9, wherein a temperature of the cooling fluid in the third passage is different from the temperature of the cooling fluid in the first passage and the temperature of the cooling fluid in the second passage.

15. The cooling structure of claim 9, wherein the first passage fluidly connects the first chamber to a first location in the wheel space, and the second passage fluidly connects the second chamber to a second location in the wheel space.

16. A cooling structure for a stationary blade, the cooling structure comprising:

an airfoil having a cooling circuit therein;

an endwall coupled to a radial end of the airfoil, relative to a rotor axis of a turbomachine;

a chamber positioned within the endwall for receiving a cooling fluid and including an upstream region and a downstream region therein, wherein the cooling fluid absorbs heat from the endwall, and a temperature of the cooling fluid in the upstream region is lower than a temperature of the cooling fluid in the downstream region;

a first passage within the endwall fluidly connecting the upstream region of the chamber to a shroud space positioned radially between the endwall and the turbine shroud, wherein a first portion of the cooling fluid in the upstream region passes through the first passage, and wherein the first passage is oriented radially with respect to the rotor axis of the turbomachine;

a second passage within the endwall fluidly connecting the downstream region of the chamber to the shroud space positioned radially between the endwall and the turbine shroud, wherein a second portion of the cooling fluid in the downstream region passes through the second passage, and wherein the second passage is oriented radially with respect to the rotor axis of the turbomachine; and a third passage within the endwall fluidly connecting the downstream region of the chamber to a region other than the shroud space, such that the third passage transmits a remainder portion of the cooling fluid which bypasses the first passage and the second passage to the region other than the shroud space, to enter the cooling circuit of the airfoil.

17. The cooling structure of claim 16, further comprising a thermally conductive fixture within the chamber for transmitting heat from the endwall to the cooling fluid.

18. The cooling structure of claim 16, wherein the chamber further includes a fore chamber and an aft chamber positioned within the endwall, wherein the fore chamber is positioned proximal to a leading edge of the airfoil, the aft chamber is positioned proximal to a trailing edge of the airfoil, the upstream region is positioned within the fore chamber, and the downstream region is positioned within the aft chamber.

19. The cooling structure of claim 16, wherein the airfoil includes a plurality of airfoils extending from the endwall, and one of the plurality of airfoils includes the cooling circuit in fluid communication with the chamber.

20. The cooling structure of claim 16, wherein the first passage fluidly connects the upstream region of the chamber to a first location in the shroud space, and the second passage fluidly connects the downstream region of the chamber to a second location in the shroud space.

* * * * *